US006914191B2

(12) United States Patent
Leith et al.

(10) Patent No.: US 6,914,191 B2
(45) Date of Patent: Jul. 5, 2005

(54) ELECTRICAL CONNECTOR FOR UNSTRIPPED INSULATED WIRE

(75) Inventors: Kenneth Leith, Jacksonville, FL (US); John Finck, Jacksonville, FL (US)

(73) Assignee: Secure Connect, LLC, Jacksonville, FL (US)

( * ) Notice: Subject to any disclaimer, the term of this patent is extended or adjusted under 35 U.S.C. 154(b) by 0 days.

(21) Appl. No.: 10/745,169

(22) Filed: Dec. 23, 2003

(65) Prior Publication Data

US 2004/0137783 A1 Jul. 15, 2004

Related U.S. Application Data

(60) Provisional application No. 60/436,304, filed on Dec. 24, 2002.

(51) Int. Cl.[7] ..... H01R 4/24
(52) U.S. Cl. ..... 174/87; 439/415
(58) Field of Search ..... 174/87; 439/415

(56) References Cited

U.S. PATENT DOCUMENTS

| | | | | | |
|---|---|---|---|---|---|
| 3,156,762 | A | * | 11/1964 | Matthysse | 174/87 |
| 3,497,607 | A | * | 2/1970 | Swanson | 174/87 |
| 3,579,172 | A | * | 5/1971 | Clark | 439/415 |
| 4,035,577 | A | * | 7/1977 | Loeber | 174/84 C |
| 5,922,994 | A | * | 7/1999 | Robinson et al. | 174/87 |
| 6,050,844 | A | * | 4/2000 | Johnson | 439/415 |
| 6,198,049 | B1 | * | 3/2001 | Korinek | 174/87 |
| 2002/0031938 | A1 | * | 3/2002 | Kaufmann et al. | 439/415 |

* cited by examiner

*Primary Examiner*—Chau N. Nguyen
(74) *Attorney, Agent, or Firm*—Mark J. Young

(57) ABSTRACT

An insulated electrical connector for securely connecting one or more unstripped insulated wires uses a conductive engagement member capable of frictionally engaging and penetrating insulation and contacting a conductive wire core.

20 Claims, 4 Drawing Sheets

FIGURE 9
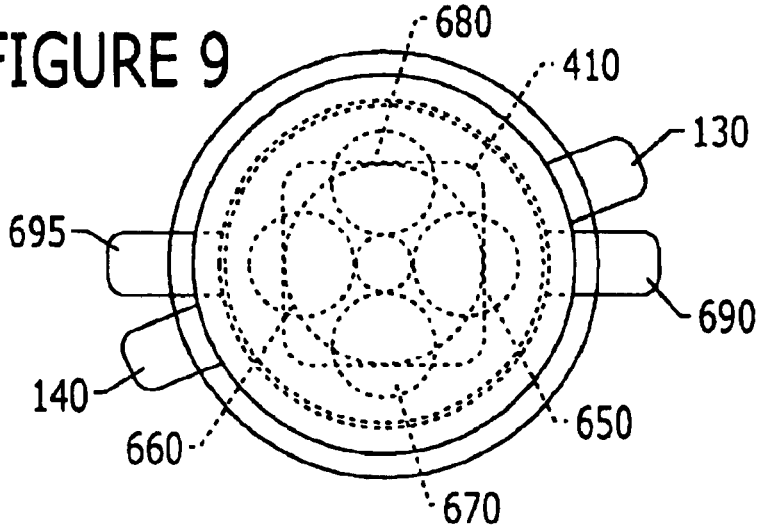
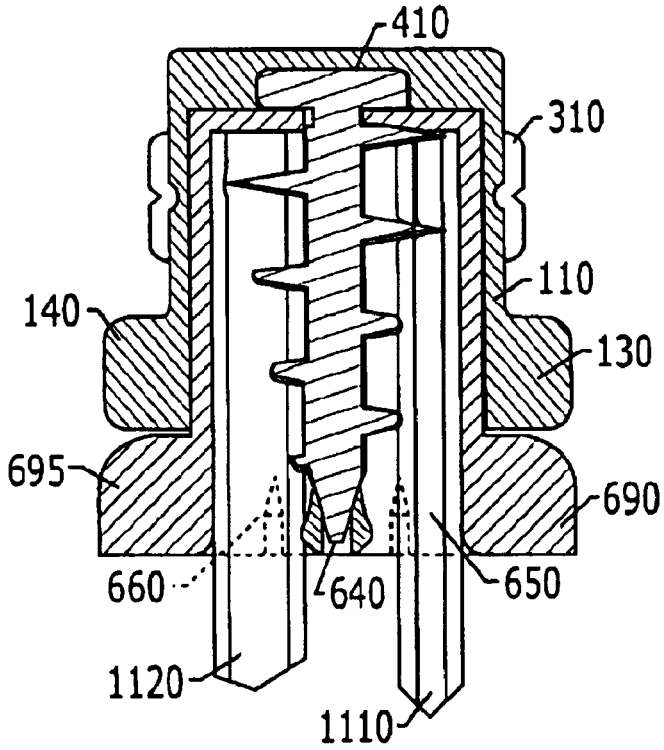
FIGURE 10

ELECTRICAL CONNECTOR FOR UNSTRIPPED INSULATED WIRE

RELATED APPLICATIONS

This application claims priority to U.S. Provisional Application 60/436,304, filed Dec. 24, 2002, the entire contents of which are hereby incorporated by reference herein.

FIELD OF THE INVENTION

The present invention pertains to an insulated electrical connector. More particularly, the present invention pertains to an insulated electrical connector for securely connecting one or more unstripped insulated wires using a conductive engagement screw capable of frictionally engaging and penetrating insulation and contacting the conductive wire.

BACKGROUND

Wire connectors are widely used to mechanically and electrically connect electrical wires. Such devices typically include a plastic insulating cap and a conductive helical coil within the cap. In use, typically a portion (e.g., ½ or ⅜ inch) of insulation must be stripped from each of the wires to be joined. Next, the stripped ends of the wires are held parallel and twisted together securely by hand or with pliers. Then, the twisted wires are inserted into the wire connector and the wire connector is twisted clockwise around the wires, forcing the wires securely into the helical coil.

Conventional wire connectors suffer several shortcomings relating to use. First, wires must be stripped before insertion into a wire connector. Stripping is tedious, time-consuming and conducive to error. If too little insulation is stripped, the insulation may prevent securely engaging the wire in the wire connector. If too much insulation is removed, the wire may need to be trimmed to prevent uninsulated wire from extending out of the wire connector. If the device used to strip insulation from the wire cuts too deep, the wire may be severed or damaged. If the device does not cut deep enough, the insulation may be damaged but remain on the wire.

Second, mechanical loads and vibrations may tend to loosen conventional wire connectors. Loosening may lead to exposure of live wires creating a fire hazard and risk of electrical shock. Loosening may also lead to increased resistance between contacting wires, which may lead to heat generation, which may further lead to increased resistance. Continued increase in resistance and heat generation may eventually lead to an electrical fire.

Third, conventional wire connectors have a gaping entrance, leaving contained wires exposed to moisture and debris. Moisture may cause oxidation of the conductive wire core and an attendant increases in resistance and heat generation. Debris may corrode the wires or lead to current leakage.

Fourth, it is often difficult to determine when wires are fully engaged within a wire connector, i.e., when there has been positive insertion. Over tightening can damage the wires and force them out of the wire connector. If the wires were nicked during stripping, the weakened wires may break during tightening. If the wires are inadequately tightened, the loose wires may experience increased resistance leading to heat generation.

Fifth, conventional wire connectors do not provide means far determining if engaged wires carry an electric current (i.e., if the engaged wires are live). Typically, to determine if the wires are live, the wires are disengaged from a wire connector and the exposed ends are placed in conductive contact with a testing apparatus, such as an ammeter, voltmeter, test light or the like.

Thus, an insulated electrical connector for quickly and securely connecting unstripped insulated wires is needed. Preferably, the connector enables an accurate assessment of positive insertion, limits exposure to moisture and debris and resists loosening from vibrations. The connector may also include means for determining if engaged wires carry an electric current (i.e., if the engaged wires are live).

SUMMARY

It is therefore an object of an exemplary embodiment of the present invention to provide an insulated electrical connector for quickly and securely connecting unstripped insulated wires.

It is another object of an exemplary embodiment of the present invention to provide an insulated electrical connector which enables an accurate assessment of positive insertion of a wire.

It is a further object of an exemplary embodiment of the present invention to provide an insulated electrical connector that limit exposure of contacted conductive wire to moisture and debris.

It is still another object of an exemplary embodiment of the present invention to provide an insulated electrical connector with means to resist loosening of electrical connections from vibrations.

It is still another object of an exemplary embodiment of the present invention to provide an insulated electrical connector with a voltage or current indicator functionally attached to the engagement member to indicate whether contained wires carry an electric current.

It is yet another object of an exemplary embodiment of the present invention to provide a reusable insulated electrical connector.

To achieve these and other objectives, the present invention provides an insulated electrical connector for quickly and securely connecting unstripped insulated wires. In a preferred embodiment, the connector enables an accurate assessment of positive insertion, limits exposure to moisture and debris and resists loosening from vibrations.

A connector in accordance with an exemplary embodiment of the present invention is comprised of a non-conductive outer housing, a conductive engagement member, and a non-conductive inner housing. The outer housing is attached to the engagement member. The inner housing receives the engagement member and one or more insulated unstripped wires. The engagement member frictionally engages and penetrates insulation of the received wires and contacts the conductive core of the wires. In a preferred embodiment a normal force generator (such as a snap ring) may provide a compressive force between the inner and outer housing and prevent outward creep and loosening of the contact between the core and the conductive wire.

In another aspect of the invention, an electrical connector according to the principles of the invention is comprised of a non-conductive outer housing having an open end, a closed end and an interior compartment; a conductive engagement member attached to the outer housing in the interior compartment; and a non-conductive inner housing having a first end with an opening for receiving the engagement member and a second end with a plurality of openings for receiving a plurality of insulated unstripped wire ends. The interior compartment of the outer housing is configured to receive at least a portion of the inner housing. The engagement member is configured and disposed to cut into or penetrate insulation on the insulated unstripped wire ends and contact conductive wire cores of the wire ends.

In a further aspect of the invention, an electrical connector according to the principles of the invention is comprised of a non-conductive outer housing having an open end, a closed end and an interior compartment; a means for conductively engaging insulated wires; and a non-conductive inner housing having an end with a plurality of openings for receiving a plurality of insulated unstripped wire ends. The means for conductively engaging insulated wires is attached to the outer housing in the interior compartment. The interior compartment of the outer housing is configured to receive at least a portion of the inner housing. The means for conductively engaging insulated wires is configurable to an engaged orientation whereby the means for conductively engaging insulated wires penetrates insulation on the insulated unstripped wire ends received in the openings and contacts conductive wire cores of the wire ends.

BRIEF DESCRIPTION OF THE DRAWINGS

The foregoing and other objects, features and advantages of the present invention will become better understood with reference to the following description, appended claims, and accompanying figures, where:

FIG. 9 is a top view of an exemplary assembled inner housing, outer housing and engagement screw of an electrical connector in accordance with the present invention;

FIG. 10 is a side cross-sectional view of an exemplary assembled inner housing, outer housing and engagement screw of an electrical connector in an engaged position in accordance with the present invention.

Those skilled in the art will appreciate that any geometries, dimensions and configurations shown in the Figures are provided for demonstrative purposes to conceptually illustrate components of an exemplary embodiment of the present invention, but not to limit the scope of the present invention. Other geometries, dimensions and configurations may be utilized within the spirit and scope of the present invention and are intended to come within the scope hereof.

DETAILED DESCRIPTION

The invention provides an electrical connector for unstripped insulated wire. The connector includes a conductive member for engaging and penetrating wire insulation and contacting the conductive core of a plurality of insulated wires. The conductive member is movable in relation to the wires to be electrically connected. A housing is provided to position the wires for functional engagement by the conductive member.

In one embodiment, an exemplary connector according to the principles of the invention employs an engagement screw as the conductive member. The engagement screw is mounted to an interior cavity of an outer housing. An inner housing includes holes or channels for receiving unstripped ends of wires through one end of the housing. A central whole or aperture at the other end of the inner housing receives the engagement screw. Upon threading the engagement screw into the aperture of the inner housing with insulated wire ends inserted in the channels, the engagement screw cuts into the wire insulation and contacts the metal conductive core of the wires.

Figure 1:
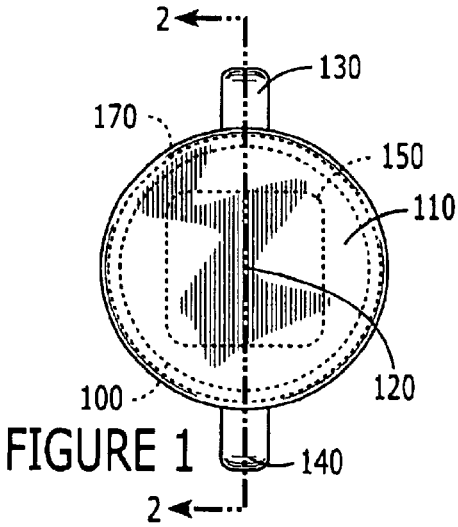
FIG. 1 is a top view of an outer housing of an exemplary electrical connector in accordance with the present invention.
Figure 2:
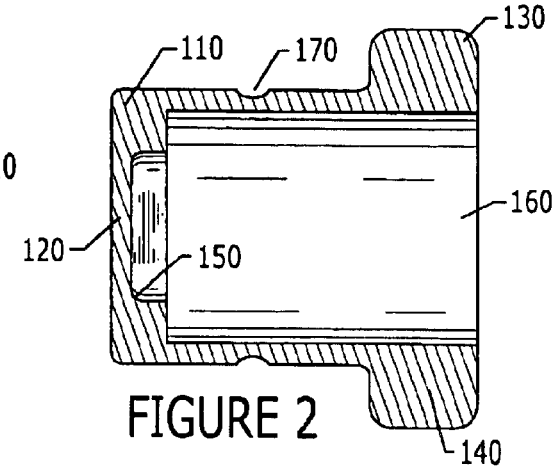
FIG. 2 is a side cross-sectional view of an outer housing of an exemplary electrical connector in accordance with the present invention.
Figure 4:
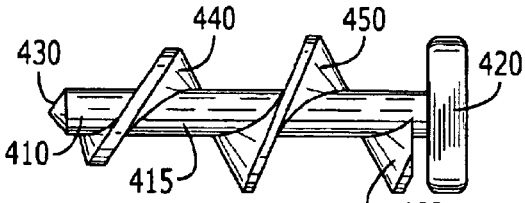
FIG. 4 is a side view of an exemplary engagement member, i.e., an engagement screw, of an electrical connector in accordance with the present invention.
Figure 6:
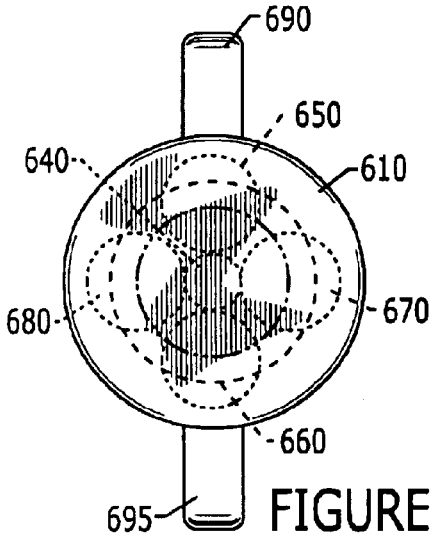
FIG. 6 is a top view of an exemplary inner housing of an electrical connector in accordance with the present invention.
Figure 7:
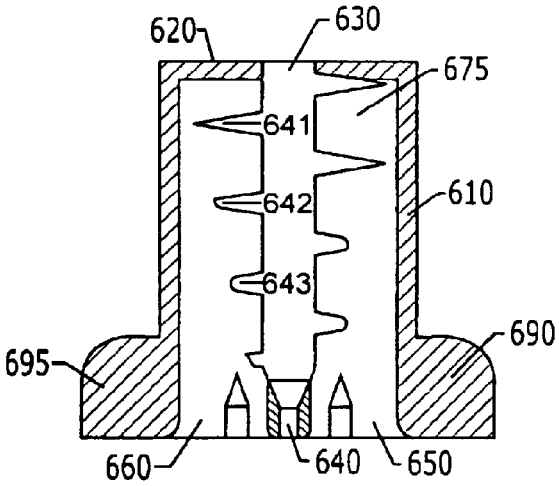
FIG. 7 is a side cross-sectional view of an exemplary inner housing of an electrical connector in accordance with the present invention.

Referring now to FIG. 1, a top view of an outer housing 110 of an exemplary electrical connector in accordance with the present invention is conceptually shown. The exterior of the outer housing 110 includes a solid top 120, a recessed region 170 for engaging a snap ring type normal force generator 310 (discussed below), and a plurality of finger torque tabs 130 and 140 to facilitate twisting. The interior of the outer housing 110 defines a compartment 160, as shown in the cross-sectional view of FIG. 2. The compartment 160 is configured to engage an inner housing 610, which is shown in FIGS. 6 and 7 and discussed more fully below. Preferably a recessed region 150 is also provided in the interior of the top of the outer housing. The recessed region 150 is configured for engaging the head or hub of an engagement screw 410, as shown in FIG. 4 and discussed more fully below.

The outer housing 110 is preferably comprised of a plastic or polymeric material that does not conduct electricity, such as polyvinyl chloride (PVC), polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and polyesters. Though many other materials may be used alone or in combination with the aforementioned materials and/or other materials, without departing from the scope of the present invention, preferably the material is relatively inexpensive and durable, easy to use in manufacturing operations and results in an aesthetically acceptable product. The material may further include additives to provide desired properties such as desired colors, structural characteristics, glow-in-the dark properties and thermal reactivity (e.g., color changes according to heat).

In one embodiment, the outer housing 110 may be comprised of a transparent material. If the inner housing 610 (as illustrated in FIG. 7) is also comprised of a transparent material, a user could observe an inserted and/or engaged wire and determine whether positive insertion is achieved and maintained. Positive insertion occurs when a wire is inserted into an electrical connector such that the tip of the inserted wire directly contacts or is adjacent to the closed end of the inside of the electrical connector. Achieving positive insertion is a serious concern to reduce fire and electrocution risks.

The outer housing 110 may be produced using any suitable manufacturing techniques known in the art for the chosen material, such as (for example) injection, compression, structural foam, blow, or transfer molding; polyurethane foam processing techniques; vacuum forming; and casting. Preferably the manufacturing technique is suitable for mass production at relatively low cost per unit, and results in an aesthetically acceptable product with a consistent acceptable quality.

Figure 3A:
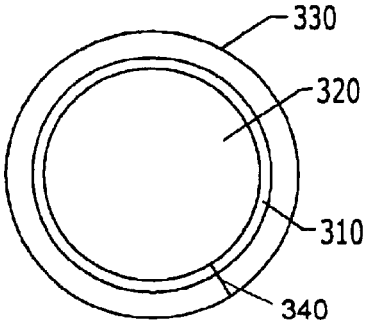
FIG. 3A is a top view of an exemplary normal force generator of an electrical connector in accordance with the present invention.
Figure 3B:
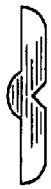
FIG. 3B is a side profile view of a section of an exemplary normal force generator of an electrical connector in accordance with the present invention.
Figure 3C:
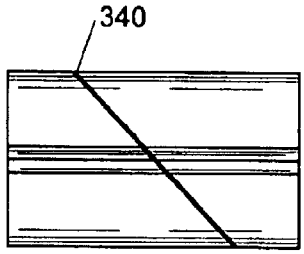
FIG. 3C is a front view of an exemplary normal force generator of an electrical connector in accordance with the present invention.

Referring now to FIGS. 3A–C, an exemplary normal force generator 310 is shown for use with an outer housing according to the principles of the invention. The exemplary normal force generator 310 is configured as a compression ring with an inner diameter 320 smaller than the diameter of the outer housing 110 at the recessed region 170, as shown in the top view of FIG. 3A. The outer diameter 330 of the normal force generator preferably accommodates a sufficient amount of material to provide a desired compressive force and structural integrity, without interfering with installation and use of the electrical connector. A cut or discontinuity 340 (as shown in the top view of FIG. 3A and the side view of FIG. 3C) in the normal force generator 310 facilitates bending expansion, enabling it to be installed around the periphery of the outer housing 110 at the recessed region 170. The cut 340 may be a straight cut or an angled cut as shown in Figure C, or a cut of another configuration.

FIG. 3B provides a side profile view of a cutaway section of the exemplary normal force generator. As can be seen, it is configured to conform with the contour 170 of the outer housing 110.

Upon installation, the normal force generator 310 provides a biasing means that preferably resists expansion of the inner housing 110 attributed to outward forces exerted by wires engaged within inner housing 610. Thus, the normal force generator 310 advantageously prevents undesired loosening of electrical and mechanical connections, thereby preventing undesired increases in resistance and heat generation as well as exposure of live wires.

Those skilled in the art will appreciate that the outer housing 110 may be comprised of material that adequately resists expansion without use of a normal force generator 310. For example, high modulus and/or fiber reinforced materials may sufficiently counteract expansive forces generated from engaged wires. In such a case, the fiber reinforced material serves as a biasing means that resists expansion of the inner housing. Such outer housings without a separate normal force generator are intended to come within the scope of the present invention. Thus, while the normal force generator may be included in an embodiment of the present invention, a connector which omits a normal force generator also comes within the scope of the present invention, so long as it does not experience appreciable expansion during a normal life cycle and operating conditions for a wire connector.

Those skilled in the art will also appreciate that a normal force generator may be located at other places on or within the connector without departing from the scope of the present invention. By way of example and not limitation, the normal force generator may be located closer to the opening or the top of the outer housing, or within the outer housing, or on the exterior of the inner housing. In each such case, the normal force generator 310 may adequately resist expansion of the inner housing 110.

Those skilled in the art will further appreciate that a normal force generator may include stiffening ribs and various geometric configurations (e.g., a toroidal, band, sleeve or flat ring shape) without departing from the scope of the present invention. Furthermore, it may be comprised of a wide array of possible materials; though, preferably, a durable, relatively inexpensive material is used such as aluminum, steel, stainless steel, other metals or alloys, or other expansion resistant materials such as fiber reinforced plastics. The material may also be corrosion resistant or treated to resist corrosion.

Referring now to FIG. 4, an exemplary conductive engagement member, namely a conductive engagement screw 410, is shown. It includes a shank 415, a hub or head 420, threads 440–460 and a tip 430, which may be pointed or blunt. The engagement member 410 frictionally engages and penetrates insulation of a received wire achieving an electrical connection. Thus, the engagement screw is configured and sized to penetrate the insulation of adjacent wire and contact the conductive core of the wire without severing the wire. Of course, the configuration and size will depend heavily on the configuration and size of the wire, inner housing and outer housing. Those skilled in the art will appreciate that a suitable configuration and size for an engagement screw may be determined based on the wire gauge and positioning of the adjacent wire relative to the engagement screw. By way of example and not limitation, assuming the closest side of the conductive core of adjacent wires will be positioned approximately ¼ inch away from the center of the engagement screw, and the insulation of the wires is 1/32 of an inch thick so that the closest side of the insulation is positioned approximately 7/32 of an inch away from the center of the engagement screw, then the cutting portions of the threads should extend approximately ¼ inch from the engagement screw's center (i.e., to the closest side of the conductive core of adjacent wires) and the conductively contacting portions of the threads should extend to at least ¼ inch from the engagement screw's center (i.e., to the closest side of the conductive core of adjacent wires).

Though a rotatable engagement screw is shown as an exemplary embodiment, those skilled in the art will appreciate that other engagement members, including (without limitation) push-in members with ribs or vanes for engaging and penetrating insulation of received wires; and helical coils with or without a shank, wherein the helicoil coil includes portions for engaging and penetrating insulation of received wires, may be used without departing from the scope of the present invention. The engagement members thus provide means for conductively engaging insulated wires.

Figure 5:
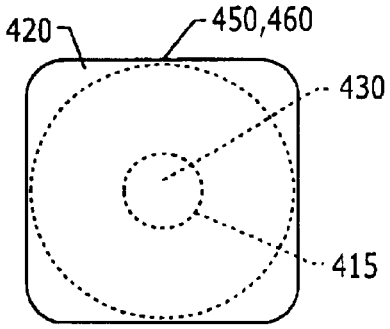
FIG. 5 is a top view of an exemplary engagement screw of an electrical connector in accordance with the present invention.

The engagement screw 410 is preferably attached to the recessed region 150 of the interior of the outer housing 110 using conventional attachment means such as adhesives. The hub 420 of the engagement screw 410, as shown in FIG. 5, may be shaped and sized to fit tightly in the recessed region 150 of the outer housing 110.

In a preferred embodiment, the geometric configuration of the threads 440–460 may vary along the length of the shank 415. The variations in thread geometry may be gradual along the length of the shank 415, or sudden changes at discrete points along shank 415. To illustrate, the pilot threads 440 proximate to the tip 430 of the shank 410 may have a relatively blunt or rounded edge for frictionally engaging insulated wire without necessarily penetrating the insulation. The incision threads 450 may have a sharp edge for penetrating insulation and protrude a greater distance from the shank 415 than do the pilot threads 440. The contact threads 460 proximate to the hub 420 of the of the screw-like member 410 may have a relatively blunt edge like the pilot threads 440, but protrude approximately the same distance from the shank 415 as the incision threads 450. The blunt edge of the contact threads 460 provides a relatively broad surface for establishing good electrical contact with an engaged conductive wire.

Threads having other geometric configurations may be used without departing from the scope of the present invention, so long as the engagement screw is capable of frictionally engaging and penetrating insulation of a received wire and establishing electrical contact with the conductive core of the penetrated wire. Additionally, an engagement screw with a single continuous thread geometry, fewer than three thread geometries, more than three thread geometries, or a continuum of varying thread geometries may also be used without departing from the scope of the present invention, so long as the engagement screw is capable of frictionally engaging and penetrating insulation of a received wire and establishing electrical contact with the conductive core of the penetrated wire. Moreover, engagement screws comprised of multiple components, such as helical threads permanently or releasably attached to a shank, may be used without departing from the scope of the present invention.

The engagement member (e.g., the engagement screw 410) is preferably comprised of a strong electrically conductive material such as steel, stainless steel, aluminum, or some other metal or alloy. The material can optionally be corrosion resistant or treated to resist corrosion so long as the treatment does not materially impair the material's electrical conductivity. The engagement screw 410 can be manufactured using screw manufacturing techniques known in the art, such as by casting or by cutting a cylindrical member into the desired engagement screw configuration.

Referring now to FIGS. 6 and 7, top and cross-sectional side views of an exemplary inner housing 610 are conceptually shown. The exterior of the inner housing 610 includes a top 620 with a tapered hole 630 for receiving the engagement screw, a bottom 640 with a plurality of openings 650–680 for receiving wires, and a plurality of finger torque tabs 690 and 695 to facilitate twisting. The exemplary openings 650–680 lead to channels sized to accommodate insulated wires. The openings may be a consistent size or different sizes. By way of example and not limitation, the openings 650–680 may be consistently sized to accommodate a determined wire gauge. Alternatively, by way of example and not limitation, some of the openings may be sized to accommodate one wire size or a limited range of wire sizes, while other openings may be sized to accommodate another wire size or limited range of wire sizes. Channels defined by the openings include exposed regions (such as 641–643) or an exposed side or portion(s) to allow the threads of the engagement screw to directly contact and operably engage the wire.

Though four openings are shown in FIG. 6, fewer openings may be provided. Alternatively, additional openings may be provided depending upon the size of the openings and the size of the inner housing 610.

The interior of the inner housing 610 defines a compartment 625 for receiving an engagement screw 410 and a plurality of wires. The compartment should include opened regions (such as near 641–643) to allow the threads of the engagement screw to directly contact and operably engage adjacent wires.

Like the outer housing, the inner housing 610 is preferably comprised of a plastic or polymeric material that does not conduct electricity, such as polyvinyl chloride (PVC), polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and polyesters. Though many other materials may be used alone or in combination with the aforementioned materials and/or other materials, without departing from the scope of the present invention, preferably the material is relatively inexpensive and durable, easy to use in manufacturing operations and results in an aesthetically acceptable product. The material may further include additives to provide desired properties such as desired colors, structural characteristics, glow-in-the dark properties and thermal reactivity (e.g., color changes according to heat). As mentioned above, the outer housing 110 and inner housing 610 may be comprised of a transparent material, thus enabling a user to observe an inserted and/or engaged wire and determine whether positive insertion is achieved and maintained.

The inner housing 610 may be produced using any suitable manufacturing techniques known in the art for the chosen material, such as (for example) injection, compression, structural foam, blow, or transfer molding; polyurethane foam processing techniques; vacuum forming; and casting. Preferably the manufacturing technique is suitable for mass production at relatively low cost per unit, and results in an aesthetically acceptable product with a consistent acceptable quality.

Figure 8:
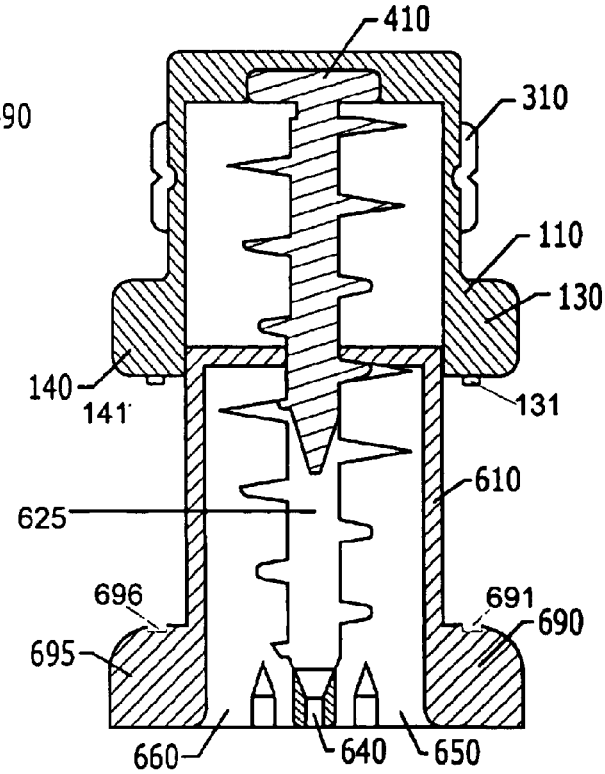
FIG. 8 is a side cross-sectional view of an exemplary assembled inner housing, outer housing and engagement screw of an electrical connector in a disengaged position in accordance with the present invention.

Referring now to FIGS. 8 and 9, side cross sectional and top views of an exemplary assembled inner housing 610, outer housing 110, normal force generator 310 and engagement screw 410 of an electrical connector in a disengaged position in accordance with the present invention are shown. A user may rotate the outer housing 110 relative to the inner housing 610 (or vice versa) causing the engagement screw 410 to enter or exit the inner housing 610.

Insulated (unstripped) wires may be inserted at openings 650 and 660, preferably until positive insertion is achieved. Advantageously, positive insertion may readily be detected by feel when the tip of an inserted wire hits the top of the inner surface of the inner housing 610. Additionally, the effect of positive insertion may readily be observed by bending (e.g., bowing) of the wire as continued insertion force is applied. Positive insertion may also be directly observed if the inner housing 610 and outer housing 110 are comprised of transparent materials.

Upon insertion, the outer housing 110 may be rotated relative to the inner housing 610 (or vice versa) causing the engagement screw 410 to enter the inner housing 610. As the engagement screw enters, the pilot threads 440 proximate to the tip 430 of the shank 410 frictionally engage the inserted insulated wires. As the engagement screw proceeds, the incision threads 450 incise the insulation and contact the conductive core of the wire. As rotation continues and the engagement screw proceeds, the contact threads 460 proximate to the hub 420 of the of the engagement screw 410 enter the incised insulation and establish electrical contact with the conductive core of the wire.

Advantageously, the exemplary engagement member provides a plurality of electrical contact areas from the incision threads 450 and the contact threads 460. This helps ensure a good electrical connection.

Referring now to FIG. 10, a side cross-sectional view of an exemplary assembled inner housing 610, outer housing 110, normal force generator 310 and engagement screw 410 of an electrical connector in an engaged position with engaged wires 1110 and 1120 in accordance with the present invention is shown. The engaged wires 1110 and 1120 may easily be disengaged and removed by rotating the outer housing 110 relative to the inner housing 610 in a direction opposite the direction of rotation for engagement. The electrical connector may then be reused.

As discussed above, the normal force generator 310 resists expansion of the inner 610 and outer 110 housings attributed to outward expansive forces generated by engaged wires and creep of the housings. Thus, the normal force generator prevents loosening of the housings and loosening of the electrical and mechanical connections with the engaged wires, thereby preventing undesired increases in resistance and heat generation as well as exposure of live wires.

Figure 11:
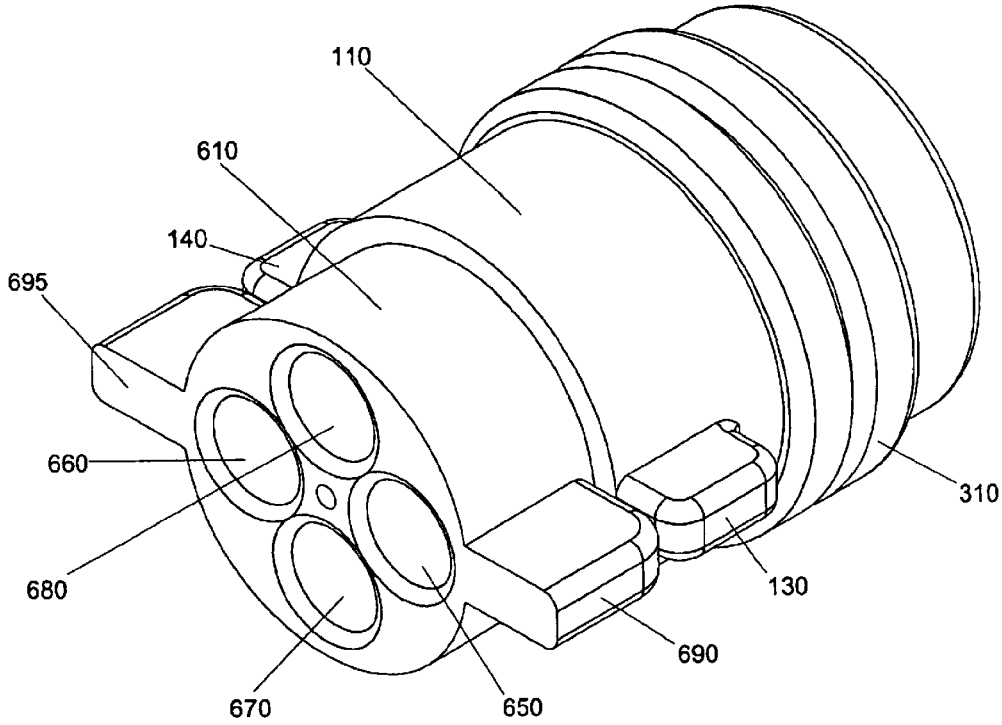
FIG. 11 is a perspective view of an exemplary assembled inner housing, outer housing and engagement screw of an electrical connector in an engaged position in accordance with the present invention.

Referring now to FIG. 11 a perspective view of an exemplary assembled inner housing 610, outer housing 110, normal force generator 310 is shown. The engagement member is contained inside the structure. Openings 650–680 are configured to receive wires before the outer housing 110 and the inner housing 610 are moved into an engaged position.

An electrical connector according to the principles of the invention may be configured to achieve a positive lock. By way of example and not limitation, finger torque tabs 690 and 695 of the inner housing 610 may be configured to releasably lock with finger torque tabs 130 and 140 of the outer housing 110. Such a configuration may include slight protrusions 131 and 141 (as shown in FIG. 8) on the finger torque tabs 130 and 140 of the outer housing 110 which mate with corresponding recesses 691 and 696 (as shown in FIG. 8) on finger torque tabs 690 and 695 of the inner housing 610 to achieve a positive lock the upon twisting the outer housing 110 relative to the inner housing 610 into an engaged position. The positive lock may be released by exerting a force to disengage the outer housing 110 from the inner housing 610. The positive lock provides a defined point of completed engagement, while resisting unintended disengagement, such as by vibration. Those skilled in the art will appreciate that other arrangements and combinations of protrusions and recesses may be used to achieve a positive lock. For example, protrusions and recesses on other cooperating components or at other locations on an electrical connector according to the principles of the invention may be used to achieve a positive lock. Such other arrangements and combinations are intended to come within the scope of the invention.

A clear advantage of use of an electrical connector in accordance with the present invention is the ability to avoid stripping wires before insertion into a wire connector. This not only saves time and consequently money, but it avoids the errors attributed to stripping. Furthermore, while not recommended, a user of an electrical connector in accordance with the present invention may establish an electrical connection between current carrying wires with less risk than incurred in stripping and handling stripped wires.

Another advantage of an electrical connector in accordance with the present invention is the ability to withstand loosening due to vibrations. The tight interaction between the inner 610 and outer 110 housings as well as the engagement screw 410 and the engaged wires 1110 and 1120 resists such loosening.

Yet another advantage of an electrical connector in accordance with the present invention is the limited exposure of the conductive wire core. In large part, the insulation remains on the wire core, helping to protect it from oxidation and interaction with debris.

An electrical connector in accordance with the present invention may be manufactured in a number of sizes, preferably accommodating the most commonly used wire gauges. For example a small electrical connector in accordance with the present invention may accommodate six (6) wires in any combination ranging from 22 to 14 AWG. A medium size electrical connector in accordance with the present invention may accommodate six (6) wires in any combination ranging from 14 to 10 AWG. A large size electrical connector in accordance with the present invention may accommodate four (4) wires in any combination ranging from 10 to 6 AWG.

While the invention has been described in terms of its preferred embodiments, those skilled in the art will recognize that the invention can be practiced with modifications within the spirit and scope of the foregoing detailed description. Such alternative embodiments and implementations are intended to come within the scope of the present invention.

Having thus described the present invention, what is claimed and desired to be secured by Letters Patent is as follows:

1. An electrical connector comprised of:

a non-conductive outer housing having an open end, a closed end and an interior compartment;

a conductive engagement member attached to the outer housing in the interior compartment; and a non-conductive inner housing having a first end with an opening and central bore with threads for receiving the engagement member and a second end with a plurality of openings for receiving a plurality of insulated unstripped wire ends, said interior compartment of said outer housing being configured to receive at least a portion of said inner housing, and said engagement member being configured and disposed to cut into or penetrate insulation on the insulated unstripped wire ends and contact conductive wire cores of the wire ends.

2. An electrical connector according to claim 1, wherein the engagement member is comprised of an engagement screw.

3. An electrical connector according to claim 1, wherein the engagement member is comprised of a helical coil.

4. An electrical connector according to claim 1, wherein the engagement member is comprised of a helical coil and a shank.

5. An electrical connector according to claim 1, wherein the engagement member is comprised of an engagement screw having variable geometry threads including a cutting portion of threads and an electrical contact portion of threads, said cutting portion of threads having a cutting edge with a first geometry, said electrical contact portion of threads having a contact edge with a second geometry, said first geometry being sharper than said second geometry.

6. An electrical connector according to claim 5, wherein the engagement screw further includes a wire insulation gripping portion of threads, said wire gripping portion of threads having a gripping edge with a third geometry, said first geometry being sharper than said third geometry.

7. An electrical connector according to claim 1, further comprising a discrete normal force generator on the outer housing.

8. An electrical connector according to claim 1, further comprising a discrete normal force generator on the inner housing.

9. An electrical connector according to claim 1, further comprising a plurality of finger torque tabs on the outer housing.

10. An electrical connector according to claim 1, further comprising a plurality of finger torque tabs on the inner housing.

11. An electrical connector according to claim 1, wherein the plurality of openings for receiving a plurality of insulated unstripped wire ends include openings of the same size.

12. An electrical connector according to claim 1, wherein the plurality of openings for receiving a plurality of insulated unstripped wire ends include openings of different sizes.

13. An electrical connector comprised of:

a non-conductive outer housing having an open end, a closed end and an interior compartment;

a means for conductively engaging insulated wires, said means for conductively engaging insulated wires being attached to the outer housing in the interior compartment; and a non-conductive inner housing having a first end with an opening and a central bore with threads for receiving the means for conductively engaging insulated wires, a second end with a plurality of openings for receiving a plurality of insulated unstripped wire ends, said interior compartment of said outer housing being configured to receive at least a portion of said inner housing, and said means for conductively engaging insulated wires being configurable to an engaged orientation whereby the means for conductively engaging insulated wires penetrates insulation on the insulated unstripped wire ends received in the openings and contacts conductive wire cores of the wire ends.

14. An electrical connector according to claim 13, being switchable between a disengaged orientation wherein the means for conductively engaging insulated wires is not engaged with insulated wires, and the engaged orientation.

15. An electrical connector according to claim 13, further comprising a biasing means for resisting expansion of the inner housing.

16. An electrical connector according to claim 13, further comprising a plurality of finger torque tabs on the outer housing.

17. An electrical connector according to claim 16, further comprising a plurality of finger torque tabs on the inner housing.

18. An electrical connector according to claim 13, wherein the plurality of openings for receiving a plurality of insulated unstripped wire ends include openings of the same size.

19. An electrical connector according to claim 13, wherein the plurality of openings for receiving a plurality of insulated unstripped wire ends include openings of different sizes.

20. An electrical connector according to claim 13, being switchable between a disengaged orientation wherein the means for conductively engaging insulated wires is not engaged with insulated wires, and the engaged orientation, said electrical connector further comprising: a biasing means for resisting expansion of the inner housing; a plurality of finger torque tabs on the outer housing; and a plurality of finger torque tabs on the inner housing; wherein the plurality of openings for receiving a plurality of insulated unstripped wire ends include openings of different sizes.

* * * * *